US010463224B2

(12) United States Patent
Lee

(10) Patent No.: US 10,463,224 B2
(45) Date of Patent: Nov. 5, 2019

(54) DISHWASHER AND CONTROLLING METHOD THEREOF

(71) Applicant: LG ELECTRONICS INC., Seoul (KR)

(72) Inventor: Sangsoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 336 days.

(21) Appl. No.: 15/363,673

(22) Filed: Nov. 29, 2016

(65) Prior Publication Data

US 2017/0188786 A1 Jul. 6, 2017

(30) Foreign Application Priority Data

Jan. 5, 2016 (KR) ..... 10-2016-0001171

(51) Int. Cl.
*A47L 15/00* (2006.01)
*A47L 15/42* (2006.01)

(52) U.S. Cl.
CPC ..... *A47L 15/4287* (2013.01); *A47L 15/0026* (2013.01); *A47L 15/0028* (2013.01); *A47L 15/0049* (2013.01); *A47L 15/4234* (2013.01); *A47L 15/4278* (2013.01); *A47L 15/4285* (2013.01); *A47L 2401/12* (2013.01); *A47L 2501/05* (2013.01); *A47L 2501/06* (2013.01); *A47L 2501/32* (2013.01)

(58) Field of Classification Search
CPC ..... A47L 2401/12; A47L 15/0026; A47L 15/0028; A47L 15/4234; A47L 15/4278; A47L 2501/32; A47L 15/4287; A47L 15/0049; A47L 2501/05; A47L 2501/06; A47L 15/4285
See application file for complete search history.

(56) References Cited

U.S. PATENT DOCUMENTS

| | | | | |
|---|---|---|---|---|
| 4,279,384 | A | 7/1981 | Yamamoto | |
| 4,289,543 | A | 9/1981 | Vallor | |
| 7,372,002 | B2 * | 5/2008 | Nakamura | D06F 39/04 219/494 |
| 2006/0289455 | A1 * | 12/2006 | Nakamura | D06F 39/04 219/494 |
| 2008/0284558 | A1 * | 11/2008 | Scheiber | D06F 58/26 337/401 |

(Continued)

FOREIGN PATENT DOCUMENTS

| | | | |
|---|---|---|---|
| CN | 101822520 | A | 9/2010 |
| CN | 101822522 | A | 9/2010 |

(Continued)

*Primary Examiner* — Alexander Markoff
(74) *Attorney, Agent, or Firm* — Dentons US LLP

(57) ABSTRACT

Disclosed a controlling method of a dishwasher comprising a water supply step for supplying wash water, a preliminary washing step for injecting the wash water to one or more dishes, a main washing step for injecting the wash water mixed with washing liquid to the dishes, a rinsing step for injecting the wash water to the dishes, and a heating step for heating the wash water in one or more of the preliminary washing step, the main washing step and the rinsing step, wherein a heater sensing step for determining an operational state of a heater heating the wash water is performed in the heating step in a state where the circulation of wash water is stopped.

10 Claims, 6 Drawing Sheets

(56) References Cited

U.S. PATENT DOCUMENTS

| | | | | |
|---|---|---|---|---|
| 2011/0114137 | A1* | 5/2011 | Jerg | A47L 15/4287 134/115 R |
| 2011/0120510 | A1* | 5/2011 | Delle | A47L 15/4291 134/115 R |
| 2011/0146718 | A1* | 6/2011 | Heidel | A47L 15/0034 134/18 |
| 2012/0279527 | A1* | 11/2012 | Lee | A47L 15/0036 134/106 |
| 2012/0287546 | A1* | 11/2012 | Kopelman | H02H 5/045 361/105 |
| 2013/0048626 | A1* | 2/2013 | Seo | D06F 39/008 219/510 |
| 2014/0352694 | A1* | 12/2014 | Row | A61M 16/1075 128/203.14 |
| 2015/0245723 | A1* | 9/2015 | Alexander | A47G 19/027 99/483 |
| 2015/0337859 | A1* | 11/2015 | Qi | F04D 1/00 415/177 |
| 2015/0359411 | A1* | 12/2015 | Kim | A47L 15/4285 134/18 |
| 2016/0051122 | A1* | 2/2016 | Lee | A47L 15/4234 134/57 D |

FOREIGN PATENT DOCUMENTS

| | | | | | |
|---|---|---|---|---|---|
| CN | 103052348 | A | | 4/2013 | |
| CN | 103799936 | A | | 5/2014 | |
| CN | 105167728 | A | | 12/2015 | |
| DE | 10142525 | A1 | | 3/2003 | |
| DE | 102009029148 | A1 | | 3/2011 | |
| DE | 102011002861 | A1 | | 7/2012 | |
| DE | 112013001575 | B4 | * | 5/2017 | D06F 39/004 |
| EP | 1595489 | A1 | * | 11/2005 | A47L 15/4225 |
| EP | 1862103 | A1 | | 12/2007 | |
| EP | 2954828 | A1 | | 12/2015 | |
| GB | 2265820 | A | | 10/1993 | |

* cited by examiner

DISHWASHER AND CONTROLLING METHOD THEREOF

CROSS-REFERENCE TO RELATED APPLICATIONS

This application claims priority to Korean Patent Application No. 10-2016-0001171 filed on Jan. 5, 2016 in Korea, the entire contents of which is hereby incorporated by reference in its entirety.

BACKGROUND OF THE DISCLOSURE

Field of the Disclosure

Embodiments of the present disclosure relate to a dishwasher, more particularly, to a dishwasher for detecting presence of errors in a heater provided therein to heat a wash water, and a controlling method thereof.

Background of the Disclosure

Generally, a dishwasher is the mechanism configured to wash and dry one or more dishes held therein by injecting wash water to the dishes at a high pressure. Specifically, wash water is injected in a washing tub where dishes are held at a high pressure and the injected wash water washes and clean out food scraps or contaminants from surfaces of dishes.

Such a dishwasher is capable of filtering the food scraps contained in the wash water and reusing the used wash water. Also, the dishwasher has dishwashing detergent or liquid dissolved in the wash water to remove the food scraps smoothly and efficiently. The dishwashers capable of enhancing washing efficiency by raising the temperature of wash water or generating steam, using a heater, have been widely popular.

Such the conventional dishwasher includes a case defining an exterior appearance; a washing tub provided in the case and defining a washing space for dishes; a driving unit provided in a lower portion of the washing tub and supplying, collecting, circulating and draining washing water for washing the dishes; lower/upper/top injecting nozzles injecting the washing water supplied by the driving unit to dishes; and lower/upper/top storage units extractable between the lower/upper/top injection units within the washing tub and selectively accommodating dishes according to kinds and sizes of dishes.

The driving unit includes a sump collecting the wash water having washed the dishes; a driving module circulating the wash water collected in the sump to the lower/upper/top injecting units; and a drainage unit draining the wash water collected in the sump after washing the dishes.

Such the conventional dishwasher includes a heater provided in a path for wash water (generally, under the washing tub or in the sump) to heat the wash water so that dishwashing detergent can be dissolved in the heated wash water or food scraps turned hard on the dishes for a long time can be soaked in the heated wash water, thereby improving washing efficiency and facilitating the washing process.

Meanwhile, in a structure of flow paths provided in the conventional dishwasher, the sump is provided in the lower portion of the washing tub to collect wash water and the driving unit is provided in the lower portion of the sump to circulate or drain the wash water. The heater for heating wash water is provided over the driving unit (specifically, in the lower portion of the washing tub or within the sump).

To using the heater in heating the wash water for washing efficiency and sanitation of dishes, the heater has to be always submerged in the wash water to prevent damage on the heater. Accordingly, when the heater arranged over the driving unit is being operated, the driving unit is also being operated to keep the heater submerged in the wash water.

Meanwhile, it has to be detected whether the heater is operated even in a state where the driving unit is being operated so as to detect an error of the heater. In this instance, unnecessary electric power has to be provided to circulate the wash water and the conventional dishwasher has a disadvantage in an aspect of energy efficiency.

In addition, the presence of the error in the heater is detected by measuring the temperature of the water heated by the heater. In other words, the amount of the wash water heated by the heater increases and the temperature of the wash water rises slowly only to become late for sensing the temperature of the wash water, in a state where the wash water is circulated by the driving unit, with the heated washing water being circulated. Accordingly, the electric power used for detecting the heater has to be supplied for a relatively long time period and the conventional dishwasher has a disadvantage of unreasonable energy efficiency.

SUMMARY OF THE DISCLOSURE

Accordingly, an object of the present invention is to address the above-noted and other problems.

An object of the present disclosure is to provide a dishwasher which is capable of preventing unnecessary power consumption in detecting presence of errors in a heater provided therein and sensing an operational state of the heater rapidly, and a controlling method for the same.

To achieve these objects and other advantages and in accordance with the purpose of the embodiments, as embodied and broadly described herein, a controlling method of a dishwasher comprises a water supply step for supplying wash water; a preliminary washing step for injecting the wash water to one or more dishes; a main washing step for injecting the wash water mixed with dishwashing detergent to the dishes; a rinsing step for injecting the wash water to the dishes; and a heating step for heating the wash water in one or more of the preliminary washing step, the main washing step and the rinsing step, wherein a heater sensing step for determining an operational state of a heater heating the wash water is performed in the heating step in a state where the circulation of wash water is stopped.

When it is set to use the heater, the heater sensing step may be performed before one or more of the preliminary washing step, the main washing step and the rinsing step.

When it is set to operate the heater, the heater sensing step may be performed after the operation of the heater is stopped for a preset time period.

The heater sensing step may compare the temperature of the heater before the operation of the heater with the temperature of the heater after the heater is operated for a preset time period and determine a difference between the temperatures.

When a difference between the temperatures is not in a preset range of temperatures, the power supplied to the heart and the dishwasher may be cut off.

The heater sensing step may comprise a stabilizing step for stabilizing the temperature of the heater by stopping the operation of the heater for a preset time period; a first temperature measuring step for measuring the stabilized temperature of the heater; a circulation stopping step for stopping the circulation of the wash water; a determining step for determining a difference between the temperature measured in the first temperature measuring step and a preset temperature of the heater; and a cutting-off step for cutting off the power supplied to the heater and the dishwasher, when the determined difference between the temperatures is not in a preset range of temperatures.

The heater sensing step may further comprise a second temperature measuring step for measuring the temperature of the heater provided with the power for a preset time period after the circulation stopping step, and the preset temperature may be the temperature of the heater measured in the second temperature measuring step.

The heater sensing step may be performed, after the heating step is performed after one or more of the preliminary washing step, the main washing step and the rinsing step.

The heater sensing step may be performed, when the temperature of the heater and the temperature of the wash water heated by the heater are lower than a preset normal temperature.

The heater sensing step ma further comprise a stabilizing step for stabilizing the temperature of the heater by stopping the operation of the heater for a preset time period after the heater is operated.

The heater sensing step may compare the temperature of the heater after the stabilizing step with the temperature of the heater after operated for a preset time period and determines a difference between the temperatures.

When a difference between the temperatures is not in a preset range of temperatures, the power supplied to the heart and the dishwasher may be cut off.

The heater sensing step may comprise a stabilizing step for stabilizing the temperature of the heater by stopping the operation of the heater for a preset time period; a first temperature measuring step for measuring the stabilized temperature of the heater; a circulation stopping step for stopping the circulation of wash water; a second temperature measuring step for measuring the temperature of the heater provided with the power for a preset time period; a determining step for determining a difference between the temperature measured in the first temperature measuring step and the temperature measured in the second temperature measuring step; and a cutting-off step for cutting off the power supplied to the heater and the dishwasher, when the determined difference between the temperatures is not in a preset range of temperatures.

In another aspect of the present disclosure, a dishwasher comprises a washing tub defining a space in which one or more dishes are placed and washed; an injection unit injecting wash water to the dishes; a sump provided in a lower portion of the washing tub; and a driving unit supplying and circulating the wash water stored in the sump to the injection unit, wherein the driving unit comprises a heating chamber supplied wash water from the sump and defining a predetermined space for heating the supplied wash water; a pumping chamber provided above the heating chamber and defining a predetermined space for pumping the wash water supplied to the heating chamber to the injection unit; a heater assembly connected to a bottom surface of the heating chamber and forming the heating chamber and the lowermost surface of the driving unit simultaneously, the heater assembly comprising a heater heating the wash water stored in the heating chamber; and a temperature sensor provided in the heater assembly and sensing a normal operation of the heater by sensing the temperature of the heater.

The heater assembly may further comprise a housing defining a bottom surface of the heating chamber and having a bottom surface to which the heater is coupled; and a heater cover coupled to a bottom surface of the housing and closing the heater, with a bottom surface in which the temperature sensor is provided.

The embodiments have following advantageous effects. The dishwasher in accordance with the present disclosure is capable of preventing unnecessary power consumption in detecting presence of errors in a heater provided therein and sensing an operational state of the heater rapidly.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein.

DESCRIPTION OF SPECIFIC EMBODIMENTS

Referring to the accompanying drawings, exemplary embodiments of the present disclosure according to one embodiment of the present disclosure will be described in detail.

Use of such terminology herein is merely intended to facilitate description of the specification, and the terminology itself is not intended to give any special meaning or function. In the present disclosure, that which is well-known to one of ordinary skill in the relevant art has generally been omitted for the sake of brevity.

Regardless of numeral references, the same or equivalent components may be provided with the same reference numbers and description thereof will not be repeated. For the sake of brief description with reference to the drawings, the sizes and profiles of the elements illustrated in the accompanying drawings may be exaggerated or reduced and it should be understood that the embodiments presented herein are not limited by the accompanying drawings.

First of all, a dishwasher in accordance with one embodiment of the present disclosure will be described, referring to the accompanying drawings.

Figure 1:
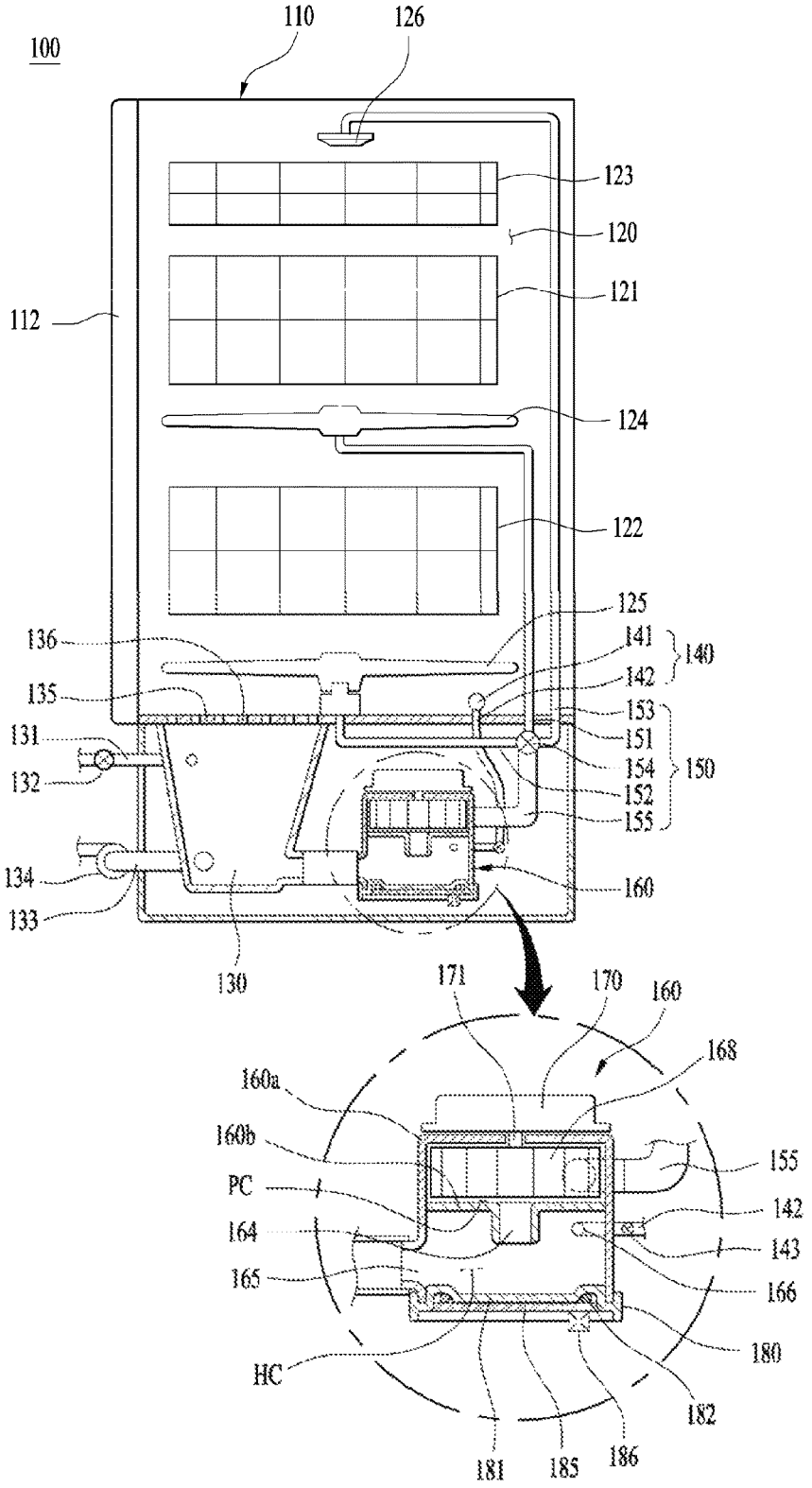
FIG. 1 is a schematic diagram illustrating an internal structure of a dishwasher in accordance with the present disclosure.
Figure 2:
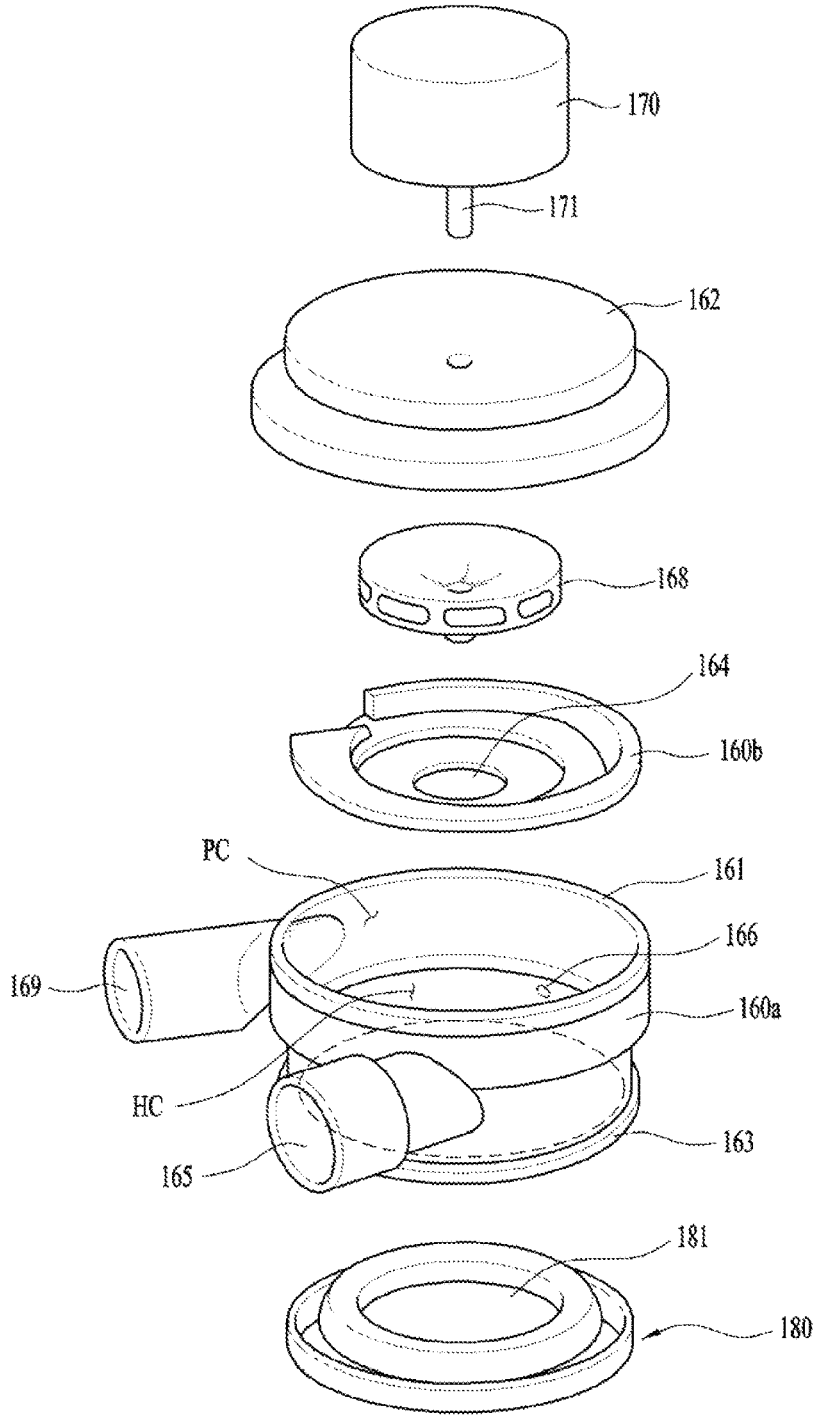
FIG. 2 is a perspective diagram illustrating a driving unit provided in the dishwasher.
Figure 3:
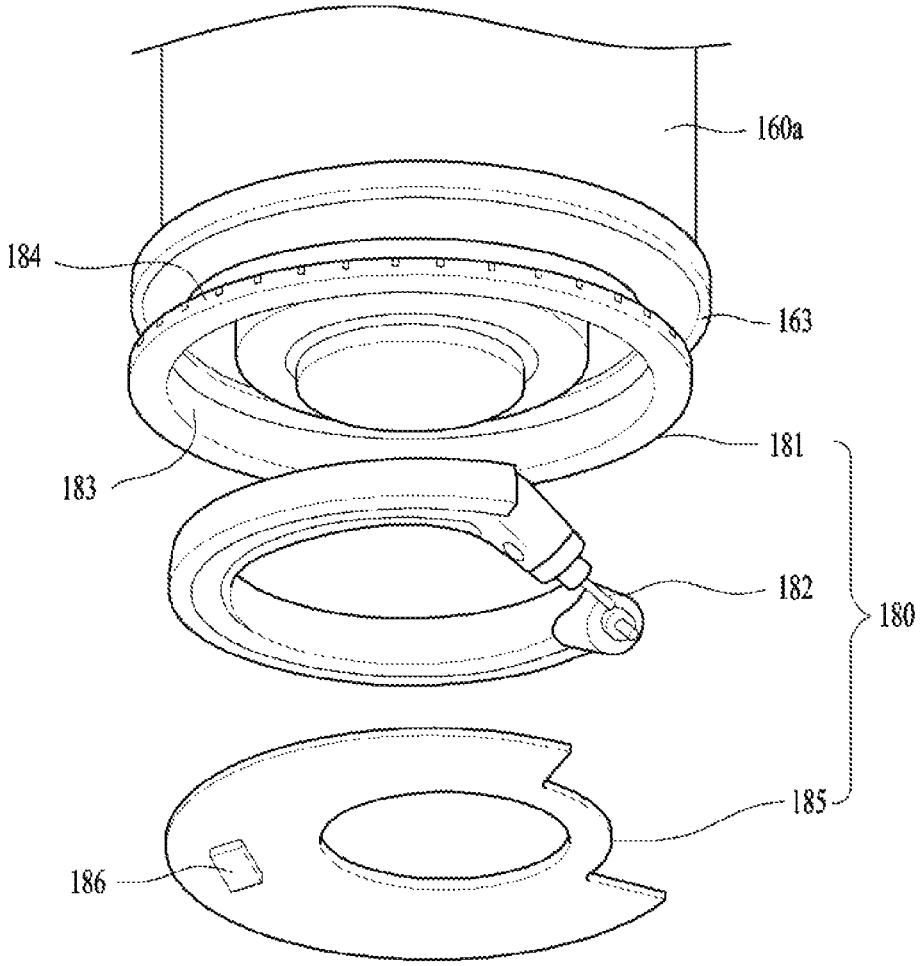
FIG. 3 is an exploded perspective diagram illustrating a heater assembly provided in the dishwasher.

FIG. 1 is a schematic diagram illustrating an internal structure of a dishwasher in accordance with the present disclosure. FIG. 2 is a perspective diagram illustrating a driving unit provided in the dishwasher. FIG. 3 is an exploded perspective diagram illustrating a heater assembly provided in the dishwasher.

The present disclosure relates to a driving unit 160 capable of performing the function for moving wash water and the function for heating the wash water at the same time, and the apparatus including the driving unit 160. FIG. 1 illustrates one example of the dishwasher including the driving unit 160 in accordance with the present disclosure.

As shown in FIG. 1, the dishwasher 100 may include a cabinet 110; a washing tub 120 provided in the cabinet and providing a washing space; an injection units 124, 126, and 126 injecting wash water to one or more washing objects; and a driving unit 160 for supplying wash water to the injection units 124, 125 and 126.

Storage units 121, 122 and 123 for storing washing objects therein may be provided in the washing tub 120. The storage units 121, 122 and 123 may include a top storage unit 123 provided adjacent to an inner top surface of the washing tub 120; an upper storage unit 121 provided in an upper portion of the washing tub 120; and a lower storage unit 122 provided in a lower portion of the washing tub 120.

The washing tub 120 is open by a door 112 coupled to one surface of the cabinet 110. After opening the washing tub 120, using the door 112, a user is able to take out the storage units 121, 122 and 123.

When the storage units 121, 122 and 123 include the top storage unit 123, the upper storage unit 121 and the lower storage unit 122, the injection units 124, 125, 126 may include a top injection unit 126 provided above the top storage unit 123 and injecting wash water to the top storage unit 123; an upper injection unit 124 provided between the top and upper storage units 123 and 121 and injecting wash water to the top and upper storage units 123 and 121; and a lower injection unit 125 provided under the lower storage unit 122 and injecting wash water to the lower storage unit 122.

In this instance, the wash water injected to washing objects from the injections units 124, 125 and 126 (the wash water remaining in the washing tub 120) may be collected in the sump 130.

The sump 130 provided under the washing tub 120 serves as the means for storing wash water. The sump 130 is partitioned off from the washing tub 120 by a sump cover 135. The sump cover 135 has a water-collecting hole 136 allowing an internal space of the washing tub 120 to communicate with an internal space of the sump 13.

Meanwhile, the sump 130 is connected to a water supply source (not shown) via a water supply path 131. The water supply path 131 may be closable by a water supply valve 132 controlled by a controller (not shown). The wash water held in the sump 130 may be drained outside the dishwasher via a drainage path 133 and a drainage pump 134.

The wash water stored in the sump 130 is supplied to the injection units 124, 125 and 126 via the water supply paths 151, 152 and 153. The water supply paths 151, 152 and 153 includes a connection path 155 connected with the driving unit 160; a top water supply path 153 connecting the top injection unit 126 with the connection path 155; an upper water supply path 151 connecting the upper injection unit 124 with the connection path 155; and a lower water supply path 152 connecting the lower injection unit 125 with the connection path 155.

The upper injection unit 124 is rotatably coupled to the upper water supply path 151 and the lower injection unit 125 is rotatably coupled to the lower water supply path 152.

The top water supply path 153, the upper water supply path 151 and the lower water supply path 152 are branched from the connection path 155. A flow transfer valve 154 may be provided at the branched points from the connection path to open and close and transfer the flow.

The driving unit 160 may include a body 160*a* fixed in the cabinet 110; a partition wall 160*b* partitioning off an internal space of the body 160*a* into a pumping chamber (PC) and a heating chamber (HC); a communicating hole 164 provided in the partition wall 160*b* and allowing the pumping chamber (PC) to communicate with the heating chamber (HC); an inlet connecting the sump 130 with the heating chamber (HC); an outlet 169 connecting the pumping chamber (PC) with the connection path 155; an impeller 168 provided in the pumping chamber (PC); and a heater assembly 180 provided in a bottom surface of the heating chamber (HC).

As shown in FIG. 2, the body 160*a* is formed in a cylindrical shape with an open top and an open bottom. A cover 162 is provided in the open top 161 provided in a top of the body 160*a* (in other words, a top surface of the pumping chamber (PC)). The heater assembly 180 is detachably coupled to the open bottom 163 (in other words, a bottom surface of the heating chamber (HC)).

The heater assembly 180 is provided in the lowermost part of the driving unit 160 and defines the bottom surface of the heating chamber (HC), so that the heating chamber (HC) can perform the wash water heating function and the wash water circulation function simultaneously. In addition, the heater assembly 180 is detachable out of the driving unit 160 from the body 160*a*.

The impeller 168 serves as the means for moving the wash water supplied to the pumping chamber (PC) from the heating chamber (HC) toward the outlet 169 and is rotatable by a motor provided in an outer surface of the body 160*a*.

In this instance, the motor 170 may be fixed to the cover 162 and a shaft 171 of the motor is directly connected to the impeller 168 through the cover 162.

As shown in FIG. 3, the heater assembly 180 may include a housing 181 defining a bottom surface of the heating chamber (HC); and a heater 182 provided in the outer surface of the heating chamber (HC) and heating the housing 181.

Accordingly, the heater 182, the housing 181, the pumping chamber (PC) and the heating chamber (HC) may be sequentially disposed according along the height of the body 160*a*, only to form mutual vertical arrangement.

Meanwhile, to transfer the thermal energy supplied by the heater 182 to the wash water held in the heating chamber (HC), it is preferred that the housing 181 is made of a conductor such as metal.

The housing 181 may include an accommodating groove 183 for locating the heater 182 outside the heating chamber (HC); and a securing portion 184 securing the housing 191 to the body 160*a*. The accommodating groove 183 may be provided in a predetermined shape capable of maximizing the surface area of the housing 181 heat-exchanging with the wash water. FIG. 3 illustrates one example of the accommodating groove 183 projected toward the internal space of the heating chamber (HC).

A heater cover 185 may be further provided and fixed to the housing 181 to prevent the heater 182 inserted in the accommodating groove 183 from becoming exposed outside the accommodating groove 183. The heater cover 185 serves the means for shutting off the wash water or foreign substances permeating into the heater 182 as well as preventing internal components of the dishwasher near the driving unit 160 from directly contacting with the heater 182.

Meanwhile, a temperature sensor 186 for sensing an operational state of the heater 182 and sensing the temperature of the housing heated by the heater 182 may be provided in a back surface of the heater cover 185.

The heater 182 may include a heater body 160*a* generating the thermal energy once provided with electric currents; and first and second terminals supplying electric currents to the heater body 160*a*. the first terminal and the second terminal may be exposed outside the accommodating groove 183 and the heater body 160*a* may not be exposed outside the accommodating groove 183 by the heater cover 185.

The housing 181 defines the bottom surface of the heating chamber (HC) in the heater assembly 180 having the structure mentioned above. Accordingly, the heater assembly 180 may supply warm water (in other words, heated wash water) to the injection unit 12, 125 and 126, when the impeller 168 is rotated during the operation of the heater 182 (in other words, while the heater 182 is being operated).

The heating chamber (HC) is located in the lowermost portion of the path for circulating and moving wash water and the housing 181 heated by the heater 182 defines the bottom surface of the heating chamber (HC), so t hat wash water can always collects in the heating chamber (HC).

Accordingly, the overheat of the heater 182 may be prevented without adjusting a water level additionally and the amount of the wash water which has to be supplied for steam or warm water may be minimized.

The heater assembly 180 is provided in the bottom surface of the heating chamber (HC) and the driving unit 160 mentioned above may perform a function as a stem generator, when only the heater 182 is operated after the predetermined amount of wash water is supplied to the heating chamber (HC).

To perform the function for generating steam, the driving unit 160 has to include a steam outlet hole 166 for exhausting the steam generated in the heating chamber (HC) outside.

As shown in FIG. 1, the steam outlet hole 166 may be in communication with the washing tub 120 via a steam supply unit 140. The steam supply unit 140 may include a steam nozzle 141 fixed to the washing tub 120; and a steam supply pipe 142 connecting the steam nozzle 141 and the steam outlet hole 166 with each other. the steam outlet hole 166 may be lower than the partition wall 160*b* and higher than the inlet 165.

Meanwhile, when the steam outlet hole 166 is provided in the heating chamber (HC), a steam valve 143 has to be further provided in at least one of the steam outlet hole 166 and the steam supply pipe 143 to prevent external air from coming into the heating chamber (HC).

The driving unit 160 having the structure mentioned above may be driven to supply the steam inside the heating chamber (HC) to the washing tub 120 via the steam supply pipe 142. As an alternative example, the steam may be supplied to the washing tub 120 via the injection unit 124, 125 and 126 and the collecting hole 136.

Hereinafter, the operation of the dishwasher in accordance with the embodiment of the present disclosure will be described, referring to the accompanying drawings. Each of components which will be described may be understood in reference to the description made above and the drawings.

Figure 4:
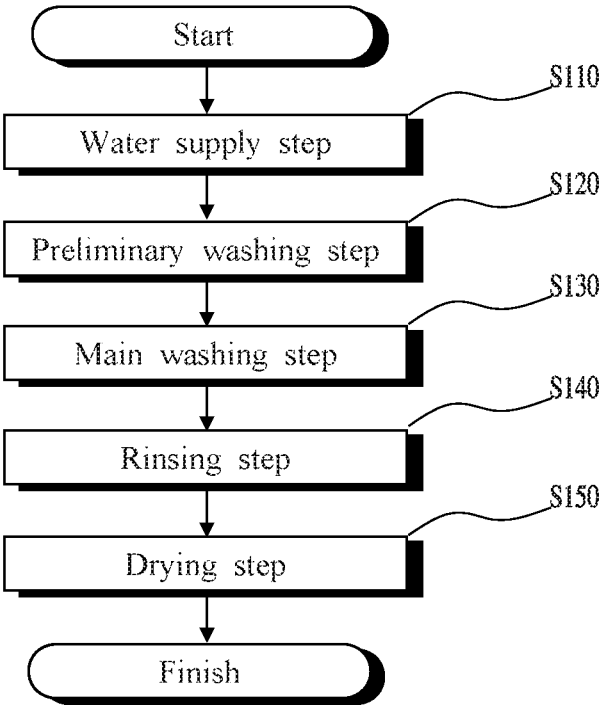
FIG. 4 is a flow chart illustrating the operation of the dishwasher in accordance with the present disclosure.

FIG. 4 is a flow chart illustrating the operation of the dishwasher in accordance with the present disclosure.

As shown in FIG. 4, the user puts one or more dishes in the storage units 121, 122 and 123 of the dishwasher and then starts a washing process by selecting a dishwashing button (not shown).

Meanwhile, once the dishwasher 100 is put into operation, a water supply step (S110) starts to start water supply to the driving unit 160 of the washing tub 120. Once the water supply step (S110) is complete, a preliminary washing step (S120) starts to soak food scraps stained on the dishes.

Once the preliminary washing step (S120) is complete, a main washing step (S130) starts to inject the wash water mixed with detergent so as to remove the food scraps or contaminants from the dishes.

Hence, the main washing step (S130) is complete and then a rinsing step (S140) starts. Once the rinsing step (S140) is complete, a drying step (S150) for drying the washed dishes starts and then the dishwashing process finishes.

Before the main washing step (S130) starts after the preliminary washing step (S120), a drainage step starts to collect and drain the wash water having injected during the preliminary washing step.

The wash water is pumped by the driving unit 160 and injected into the washing tub 120 via the upper injection unit 124 and the lower injection unit 125. Such a wash water injecting process is repeatedly performed for a preset time period.

As an alternative example, a wash water injecting frequency is preset and the main washing step (S130) is performed until the preset injecting frequency. After the main washing step (S130), the rinsing step (S140) starts and the wash water supplied in the main washing step (S130) before the rinsing step (S140).

Meanwhile, the rinsing step (S140) finishes and a drying step (S150) for removing moisture from the dishes then starts. The drying step (S150) is implemented to supply hot air to the washing tub 120 and evaporate the moisture remaining on the dishes.

In this instance, the air changed into a state of a high temperature and humidity is exhausted outside the dishwasher 100 by a drying module (not shown).

The water supply step (S110), the preliminary washing step (S120), the main washing step (S130), the rinsing step (S140) and the drying step (S150) which are mentioned above may be similar to the processes of the conventional dishwasher. Accordingly, detailed description about each of the steps will be omitted.

Meanwhile, a wash water heating step for heating and supplying the wash water injected in each of the steps may be further provided so as to enhance dish washing efficiency and dish sanitation.

The wash water heating step may be implemented to supply the wash water heated by the heater assembly 180 while passing through the heating chamber (HC) and the pumping chamber (PC) formed in the driving unit 160.

The temperature sensor 186 provided in the heater assembly 180 may sense whether the temperature of the heated wash water (warm water) reaches a target temperature or whether the heater 183 is operated in a normal mode.

Such the sensing process with respect to the heater 182 may be performed in one or more of the preliminary washing step (S120), the main washing step (S130) and the rinsing step (S140) which use warm water.

Next, a process for sensing the normal operation of the heater 182 when the warm water heated by the heater 182 is used in each of the steps for the dishwashing will be described.

In case it is set to use the heater 182 in the dish washing step, the normal operation of the heater may be sensed in the first one of the preliminary washing step (S120), the main washing step (S130) and the rinsing step (S140) which uses warm water.

Figure 5:
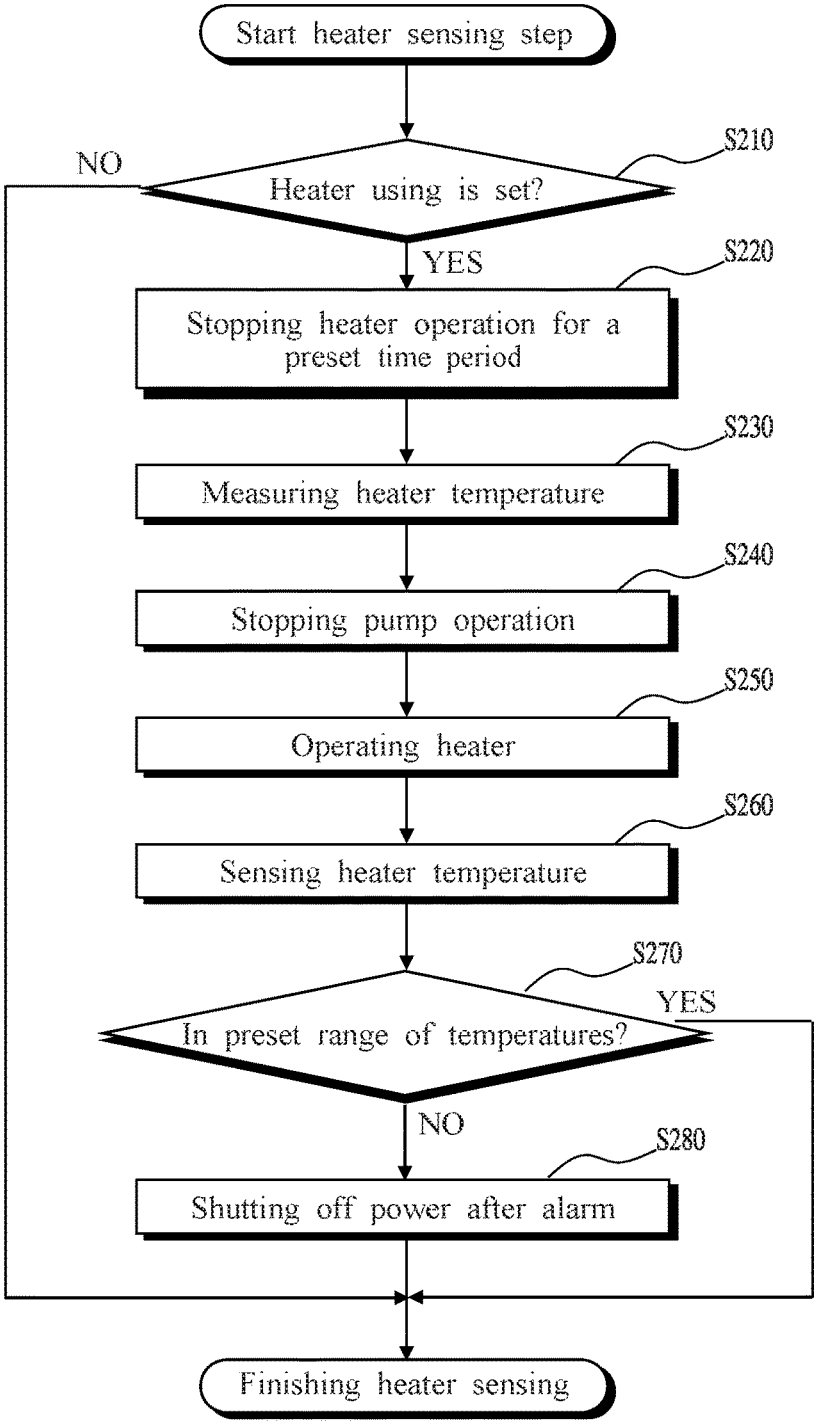
FIG. 5 is a flow chart illustrating detection of the heater operation in the dishwasher in accordance with one embodiment.

FIG. 5 is a flow chart illustrating detection of the heater operation in the dishwasher in accordance with one embodiment.

In the illustrated embodiment, the operational state of the heater 182 may be sensed before each of the steps (S110, S120, S130 and S140) for the dishwashing or a specific step selected to use the warm water.

This embodiment senses the normal operation of the heater is sensed before the preliminary washing step (S120) which is the first one using the warm water out of the preliminary washing step (S120), the main washing step (S130) and the rinsing step (S140). However, the normal operation of the heater may be sensed before one of the main washing step (S130) and the rinsing step (S140) rather than the preliminary washing step (S120).

First of all, it is determined whether it is set to use warm water in the preliminary washing step (S120), before the preliminary washing step (S120) starts. when it is not set to use warm water in the preliminary washing step (S120) based on the result of the determination, a normal preliminary washing step (S120) starts (S210).

However, when it is set to use warm water in the preliminary washing step (S120) based on the result of the determination, the operation of the heater 182 is paused for a preset time period to stabilize the temperature of the heater 182 (S220). That step is configured to check initial temperatures of the heater 182. When the heater 182 is used in the former dish washing step or one of the former steps, there is residual heat in the heater 182 and it is impossible to determine the initial temperature of the heater 182.

Accordingly, it is necessary to stabilize the temperature of the heater 182 by stopping the operation of the heater 182. At this time, the heater 182 may be cooled to the initial temperature by the wash water circulated to lower the temperature of the heater 182. The heater temperature stabilizing step may be performed for three to eight seconds.

The initial temperature of the heater 182 is measured once the heater temperature stabilizing step is complete. The temperature sensor 186 provided in the heater cover 185 of the heater assembly 180 (S230).

In case the wash water is circulated by the driving unit 160, the circulation of the wash water is stopped (S240). When the wash water is circulated by the driving unit 160, the heater is provided with the power and the heat generated by the electric power for heating the heater 182 heats the circulated water, only to loosen the rapid rise of the temperature of the heater 182. Accordingly, the temperature of the heater 182 may be rapidly raised by stopping the circulation of the wash water.

Hence, the heater 182 is provided with the electric power and put into operation (S250). The electric power is supplied to the heater 182 approximately for thirty seconds to one minute and thirty seconds. At this time, the wash water heated by the heater 182 is not being circulated and the heater assembly 180 heats only the wash water held in the heating chamber (HC), so that a small amount of wash water may be heated by the heater 182. Accordingly, the heater 182 has less heat loss enough to raise the temperature of the heater 182 rapidly.

After that, the temperature sensor provided in the heater assembly 180 senses the temperature of the heater 182 (S260) and determines whether the sensed temperature of the heater 182 belongs to a preset range of temperatures (S270). When the sensed temperature of the heater 182 is within the preset range, the heater sensing step finishes and the next step (for example, the main washing step (S130) or the rinsing step (S140)) starts. In contrast, when the temperature of the heater 182 is under the preset range, the power supply to the heater 182 is stopped and an alarm is displayed to the user (S280).

Hereinafter, the process for sensing the operation of the heater 182 when the sensed temperature of the heater 182 is lower than the present range of the temperatures will be described.

Figure 6:
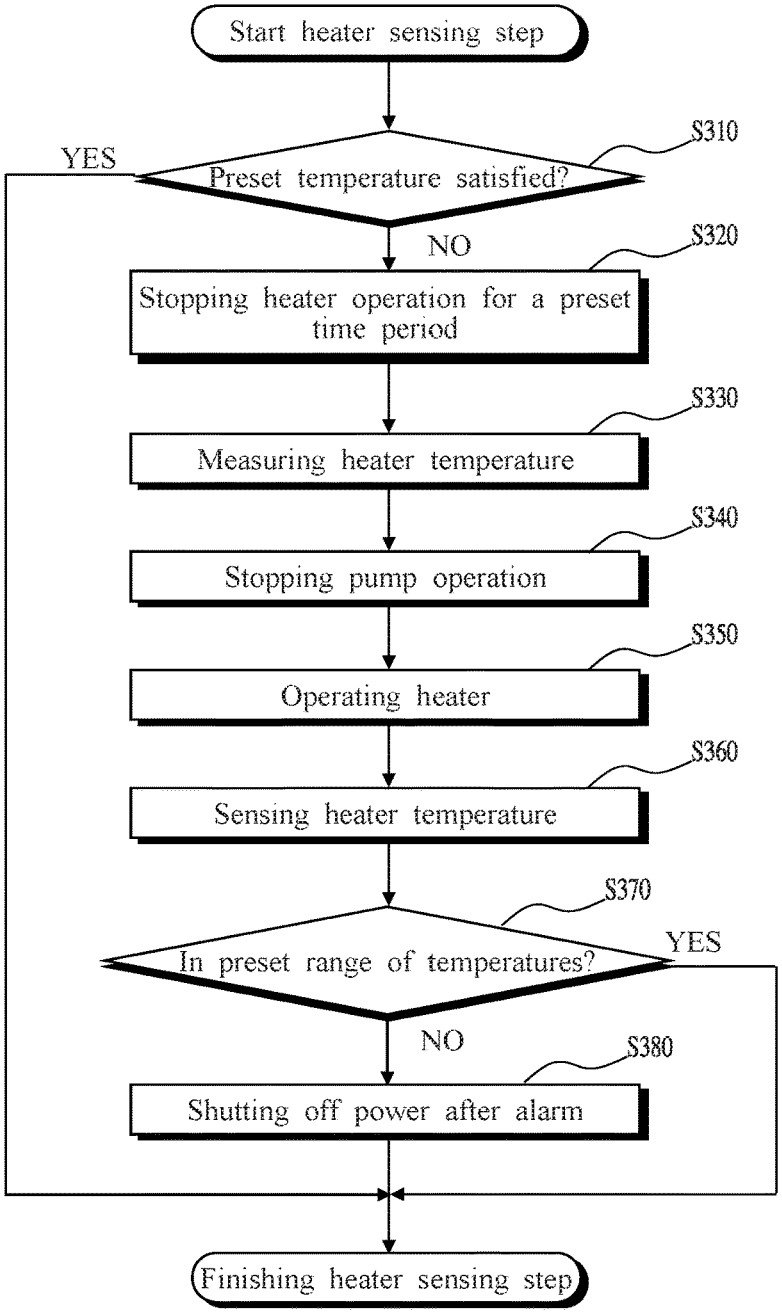
FIG. 6 is a flow chart illustrating detection of the heater operation in the dishwasher in accordance with another embodiment.

FIG. 6 is a flow chart illustrating detection of the heater operation in the dishwasher in accordance with another embodiment.

The illustrated embodiment of the present disclosure may sense an operational state of the heater 182 after performing the steps for washing the dishes (S110, S120, S130 and S140) or a specific step set to use warm water.

The illustrated embodiment may sense a normal operation of the heater after performing the first one which uses warm water out of the preliminary washing step (S120, the main washing step (S130) and the rinsing step (S140). As one alternative example, the normal operation of the heater may be sensed after one of the main washing step (S130) and the rinsing step (S140) is performed.

First of all, as shown in FIG. 6, the temperature of the heater (or the temperature of warm water) is sensed after the preliminary washing step (S120) is performed and it is determined whether the sensed temperature belongs to a preset range of temperatures (S310).

When the sensed temperature belongs to a preset range of normal temperatures based on the result of the determination, the next step of the preliminary washing step (S120) is performed (S310). However, when the sensed temperature of the heater (or the warm water) is out of the present range of the normal temperatures, the operation of the heater 182 is stopped for a preset time period and the temperature of the heater 182 is stabilized (S320).

That process is performed to check the initial temperature of the heater. If the heater 182 is used in the former dishwashing course or step, the heater 182 has a residual heat and it is impossible to determine the initial temperature of the heater 182.

Accordingly, it is necessary to stabilize the temperature of the heater 182 by stopping of the heater operation. To lower the temperature of the heater rapidly, the heater 182 may be cooled until having the initial temperature by circulating the wash water rapidly.

Meanwhile, once the heater temperature stabilizing process is complete, the initial temperature of the heater 182 is measured. The temperature sensor 186 provided in the heater cover 185 of the heater assembly 180 (S330).

In case the wash water is being circulated by the driving unit, the circulation of the wash water is stopped (S340). If the wash water is circulated by the driving unit 160, the heater 182 is provided with the power and the heat generated by the power using in heating the heater heats the wash water enough to loosen the rise of the temperature of the heater 182. The circulation of the wash water is stopped to rapidly raise the temperature of the heater.

Hence, the heater 182 is provided with the power and put into operation (S350). The power is supplied to the heater 182 approximately for thirty seconds to one minute and thirty seconds. At this time, the wash water heated by the heater 182 is not being circulated and the heater assembly 180 heats only the wash water held in the heating chamber (HC) so that a small amount of wash water may be heated by the heater 182. Accordingly, the heater 182 has less heat loss and the temperature of the heater 182 rises rapidly.

After that, the temperature sensor provided in the heater assembly 180 senses the temperature of the heater 182 (S360) and it is determined whether the temperature of the heater 182 belongs to a present rage of temperatures (S370).

When the temperature of the heater 182 is in the present range of the temperatures, the heater sensing step finishes and the next step (for example, the main washing step (S130) or the rinsing step (S140)) starts. however, when the temperature of the heater 182 is under the present range, the power supply to the heater 182 is stopped and an alarm is displayed to user (S380).

According to the dishwasher and the controlling method thereof in accordance with the present disclosure as mentioned above, unnecessary power consumption may be prevented when sensing an abnormal state of the heater provided in the dishwasher and the operational state of the heater may be rapidly sensed.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A dishwasher controlling method comprising:

a water supply step of supplying wash water;

a preliminary washing step of injecting the supplied wash water onto one or more dishes;

a main washing step of injecting the wash water mixed with dishwashing detergent onto the dishes;

a rinsing step of injecting the wash water onto the dishes;

a heating step of heating the wash water using a heater in one or more of the preliminary washing step, the main washing step, and the rinsing step;

a heater sensing step comparing the temperature of the heater before the operation of the heater with the temperature of the heater after the heater is operated for a first preset time period in a state where the circulation of wash water is stopped and determines a difference between the temperatures; and a cutting-off step of removing the power supplied to the heater and the dishwasher, when the determined difference between the temperatures is not in a preset range.

2. The controlling method of claim 1, wherein when the heater is required, the heater sensing step is performed before one or more of the preliminary washing step, the main washing step, and the rinsing step.

3. The controlling method of claim 2, wherein when the heater is required, the heater sensing step is performed after the operation of the heater is stopped for a preset time period.

4. The controlling method of claim 1, wherein the heater sensing step comprises:

a stabilizing step of stabilizing the temperature of the heater by stopping the operation of the heater for a preset time period;

a first temperature measuring step of measuring the stabilized temperature of the heater;

a circulation stopping step of stopping the circulation of the wash water; and a determining step of determining a difference between the temperature measured in the first temperature measuring step and a preset temperature of the heater.

5. The controlling method of claim 4, wherein the heater sensing step further comprises:

a second temperature measuring step of measuring the temperature of the heater provided with the power for a preset time period after the circulation stopping step, wherein the preset temperature is the temperature of the heater measured in the second temperature measuring step.

6. The controlling method of claim 1, wherein the heater sensing step is performed after the heating step of one or more of the preliminary washing step, the main washing step, and the rinsing step.

7. The controlling method of claim 6, wherein the heater sensing step is performed when the temperature of the heater and the temperature of the wash water heated by the heater are lower than a preset normal temperature.

8. The controlling method of claim 6, wherein the heater sensing step further comprises:

a stabilizing step of stabilizing the temperature of the heater by stopping the operation of the heater for a preset time period after the heater is operated.

9. The controlling method of claim 8, wherein the heater sensing step compares the temperature of the heater after the stabilizing step with the temperature of the heater after a preset time period of operation and determines a difference between the temperatures.

10. The controlling method of claim 1, wherein the heater sensing step comprises:

a stabilizing step of stabilizing the temperature of the heater by stopping the operation of the heater for a preset time period;

a first temperature measuring step of measuring the stabilized temperature of the heater;

a circulation stopping step of stopping the circulation of wash water;

a second temperature measuring step for measuring the temperature of the heater provided with power for a preset time period; and a determining step of determining a difference between the temperature measured in the first temperature measuring step and the temperature measured in the second temperature measuring step.

* * * * *